US005601970A

United States Patent [19]

Lok

[11] Patent Number: 5,601,970

[45] Date of Patent: Feb. 11, 1997

[54] PHOTOGRAPHIC ELEMENTS EXHIBITING IMPROVED STABILITY

[75] Inventor: Roger Lok, Rochester, N.Y.

[73] Assignee: Eastman Kodak Company, Rochester, N.Y.

[21] Appl. No.: 367,961

[22] Filed: Jan. 3, 1995

[51] Int. Cl.[6] ..... G03C 1/34

[52] U.S. Cl. ..... 430/610; 430/569; 430/603; 430/611

[58] Field of Search ..... 430/610, 611, 430/603, 567, 569

[56] References Cited

U.S. PATENT DOCUMENTS

| | | | |
|---|---|---|---|
| 2,057,764 | 10/1936 | Brunken | 95/8 |
| 2,440,110 | 4/1948 | Mueller | 95/7 |
| 2,440,206 | 4/1948 | Mueller | 95/7 |
| 3,043,696 | 7/1962 | Herz et al. | 96/108 |
| 3,057,725 | 10/1962 | Herz et al. | 96/109 |
| 3,226,232 | 12/1965 | Dersch et al. | 96/61 |
| 3,397,986 | 8/1968 | Millikan et al. | 96/109 |
| 3,447,925 | 6/1969 | Dersch et al. | 96/66.5 |
| 3,466,173 | 9/1969 | Ishikawa et al. | 96/95 |
| 3,615,534 | 10/1971 | Tajima | 96/67 |
| 3,761,277 | 9/1973 | Vandenberge et al. | 96/109 |
| 3,895,951 | 7/1975 | Riester et al. | 96/100 |
| 4,115,129 | 9/1978 | Bigelow . | |
| 4,241,155 | 12/1980 | Hara et al. | 430/17 |
| 4,410,619 | 10/1983 | Kubbota et al. | 430/234 |
| 4,770,987 | 9/1988 | Takahashi et al. | 430/546 |
| 4,829,046 | 5/1989 | Whitcomb | 503/211 |
| 4,939,072 | 7/1990 | Morigaki et al. | 430/372 |
| 4,980,275 | 12/1990 | Goddard | 430/551 |
| 5,006,438 | 4/1991 | Ishikawa et al. | 430/372 |
| 5,043,256 | 8/1991 | Otani | 430/550 |
| 5,266,457 | 11/1993 | Kojima et al. | 430/601 |
| 5,356,770 | 10/1994 | Lok et al. | 430/611 |

FOREIGN PATENT DOCUMENTS

| | | |
|---|---|---|
| 0298321 | 1/1989 | European Pat. Off. . |
| 0305926 | 3/1989 | European Pat. Off. . |
| 0358170 | 3/1990 | European Pat. Off. . |
| 0367227A3 | 5/1990 | European Pat. Off. . |
| 0267483B1 | 1/1992 | European Pat. Off. . |
| 0325235 | 4/1993 | European Pat. Off. . |
| 1308938 | 3/1973 | United Kingdom . |

OTHER PUBLICATIONS

Defensive Publication 864,011, published Jul. 15, 1969.

U.S. Statutory Invention Registration H706, published Nov. 7, 1989.

*Primary Examiner*—Thorl Chea

*Attorney, Agent, or Firm*—Peter C. Cody; Sarah Meeks Roberts

[57] ABSTRACT

This invention provides a photographic element comprising a support having thereon a silver halide emulsion layer which is greater than about 50 mole % silver chloride, wherein the emulsion layer contains a thiophosphate ester of the structure:

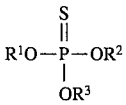

wherein $R^1$, $R^2$ and $R^3$ are independently selected from the group consisting of an aliphatic, carbocyclic or heterocyclic group.

12 Claims, No Drawings

PHOTOGRAPHIC ELEMENTS EXHIBITING IMPROVED STABILITY

FIELD OF THE INVENTION

This invention relates to the use of addenda in silver halide photographic elements to improve the elements' stability and resistance to thermally induced sensitivity changes during printing.

BACKGROUND OF THE INVENTION

Photofinishers that use photosensitive paper to produce color prints desire short processing times in order to increase output. One way of obtaining rapid processing times is to accelerate the development time by increasing the chloride content of the emulsions used in the photographic paper. However, increasing chloride content has attendant disadvantages, one of which is the increased propensity for storage deterioration.

Photographic emulsions that have high silver chloride content are prone to fogging and sensitivity changes when stored in high temperature and humidity conditions. Such changes may vary from layer to layer thus resulting in color imbalance and loss of quality in the printed material. Attempts have been made to reduce fog formation during storage by addition of inhibitory agents to the silver halide emulsions. For example, U.S. Pat. Nos. 2,440,110; 3,043,696; 3,057,725; 3,226,232; 3,397,986; 3,447,925; and 3,761,277, as well as Defensive Publication 864,011, describe the addition of organic disulfides to silver halide emulsions to lessen the tendency towards fog growth.

High chloride photographic emulsions also have an undesirable sensitivity to temperature changes during printing. For example, when the temperature of an emulsion upon printing increases due to a rise in room temperature, temperature irregularities of the printer's platen, or heat from an exposing element, the print density changes if the printing conditions are left at the initial set values. This may result in prints whose densities are different from those exposed at the normal temperature. This density difference contributes to print variability and is not acceptable to photofinishers. Very often, an increase in temperature during printing of the paper may result in a selective increase in speed in one layer, for instance the cyan layer, over another light sensitive layer, such as the magenta layer. This results in improper color balance of the color print, and requires the photofinisher to readjust printing conditions in order to compensate for the density fluctuation. Operating efficiency thus suffers.

The deficiencies of using high silver chloride emulsions is recognized in the art. In particular, EP 0 367 227 (1988) discusses reducing heat sensitivity by employing certain spectral sensitizing dyes in combination with mercapto azoles. However, these dye structures have not proved to be entirely satisfactory in terms of minimizing heat sensitivity while still maintaining optimal sensitization efficiency. EP 0 325 235 describes using iron ion donating compounds in high chloride photographic elements to reduce their change in sensitivity due to exposure at elevated temperatures. A combination of sulfinate and diamino disulfides has been used to address this problem in U.S. Pat. No. 5,356,770. Despite these attempts to address the heat sensitivity problem, no solution has been found which completely eliminates the above concerns.

U.S. Statutory Invention Registration H706 and EP 0 305 926 disclose the use of sulfinates in combination with sulfonates to reduce stain in photographic paper. U.S. Pat. No. 2,440,206 discloses the use of the combination of sulfinates and small amounts of polythionic acids to stabilize photographic emulsions against fog growth. U.S. Pat. No. 2,440,110 discloses the combination sulfinates and small amounts of aromatic or heterocyclic polysulfides as being effective in controlling fog growth. EP 0 358 170 discloses the combination of thiosulfonates and sulfinates for sensitization of direct positive photographic materials. In EP 0 267 483, sulfinates are added during the sensitization of silver bromide emulsions. The use of a paper base which has been treated with a sulfinic acid salt is known from U.S. Pat. No. 4,410,619. Similarly, British Patent 1,308,938 discloses the use of sulfinates during processing to minimize discoloration of the image tone. Sulfinates are also described as having fog reducing properties in U.S. Pat, No. 2,057,764.

Two references, U.S. Pat. Nos. 4,115,129 and 5,266,457, disclose the incorporation of phosphorous containing compounds in photographic emulsions and elements. In U.S. Pat. No. 5,266,457, sulfur sensitizers containing a thiophosphoryl moiety are disclosed as being stable under varying pH and pAg conditions. The photographic materials described in this patent are also alleged to exhibit improved antifogging, reproducibility, and sensitivity. In U.S. Pat. No. 4,115,129, photographic silver halide emulsions sensitized by digestion at a pH of at least 7 with an organophosphine sulfide added before or during digestion are disclosed. Neither patent, however, provides a means by which to adequately control the sensitivity response of high chloride emulsions to changing temperatures during printing. Thus, there remains the need for the development of effective methods for controlling the heat sensitivity of photographic emulsions and elements. Further, there exists the desire to provide such methods that will also be capable of enhancing the storage stability of photographic emulsions and elements.

SUMMARY OF THE INVENTION

This invention provides a photographic element comprising a support having thereon a silver halide emulsion layer which is greater than about 50 mole % silver chloride, wherein the emulsion layer contains a thiophosphate ester of the structure:

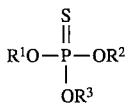

wherein $R^1$, $R^2$ and $R^3$ are independently selected from the group consisting of an aliphatic, carbocyclic or heterocyclic group, and wherein any two of $R^1$, $R^2$ and $R^3$ may be bonded together to form a 5 or 6-membered ring.

In an alternative embodiment of the invention, the above described photographic element further comprises a sulfinate compound of the structure:

$$Z—SO_2M$$

wherein Z is selected from the group consisting of an aliphatic, carbocyclic, or heterocyclic group, and M is a cationic counterion.

The invention provides the opportunity to obtain high chloride photographic elements that can be rapidly processed and that exhibit little variation in sensitivity upon changes in printing temperature, while maintaining high resistance to storage changes. This allows for high quality prints without the need for constant readjustment of printing conditions during processing.

DETAILED DESCRIPTION OF THE INVENTION

This invention concerns high chloride silver halide elements which contain a thiophosphate ester compound and which exhibit the desired characteristics of storage stability and resistance to temperature changes during printing. Specifically, the elements contemplated by the invention include a compound of the structure:

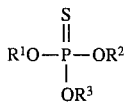

wherein $R^1$, $R^2$ and $R^3$ are independently selected from the group consisting of an aliphatic, carbocyclic (which includes aryl) or heterocyclic (which includes heteroaryl) group. These groups are further defined in accordance with the definitions set forth in Grant and Hackh's *Chemical Dictionary,* fifth. ed., McGraw-Hill 1987, and are in accordance with general rules of chemical nomenclature. The groups as defined may be substituted or unsubstituted, such substituents, if any, rendering the compounds operative to achieve the advantages of the present invention, and capable of being readily determined by one of ordinary skill in the art. Exemplary substituents are set forth below.

Exemplary aliphatic groups include alkyl, alkene, and alkyne groups, for instance methyl, ethyl, propyl, butyl, pentyl, hexyl, octyl, nonyl, decyl, dodecyl, hexadecyl, octadecyl, isopropyl, t-butyl, butenyl, propynyl, and butynyl.

Exemplary carbocyclic groups are phenyl, tolyl, naphthyl, cyclohexyl, cycloheptatrienyl, cyclooctatrienyl, and cyclononatrienyl.

Exemplary heterocyclic groups are pyrrole, furan, tetrahydrofuran, pyridine, picoline, piperidine, morpholine, pyrrolidine, thiophene, oxazole, thiazole, imidazole, selenazole, tellurazole, triazole, tetrazole, and oxadiazole.

Groups suitable for substitution on each R include alkyl groups (for example, methyl, ethyl, hexyl), fluoroalkyl groups (for example, trifluoromethyl), alkoxy groups (for example, methoxy, ethoxy, octyloxy), aryl groups (for example, phenyl, naphthyl, tolyl), hydroxy groups, halogen groups, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxy groups, cyano groups, sulfo groups, and amino groups.

It is preferred that in the practice of the present invention, each R independently represents an alkyl group having from 1 to 20 carbon atoms, optionally substituted with a halogen, or an aryl group having from 6 to 20 carbon atoms, which is optionally substituted with a halogen or an alkyl group. More preferred, each R represents an alkyl group having from 1 to 10 carbon atoms, again optionally substituted with a halogen, or an aryl group having 6 to 10 carbon atoms, optionally substituted with a halogen or an alkyl of less than 5 carbon atoms. Though contemplated, thiophosphate esters wherein each R represents a butyl group, are least preferred.

It is contemplated that any two of $R^1$, $R^2$ and $R^3$ may be bonded together to form a 5 or 6-membered ring. Examples of such rings include 1,3,2-dioxaphosphorinan, 1,3,2-benzodioxaphosphole, and 1,3,2-dioxaphosphole.

Specific examples of the thiophosphate ester compounds utilized in the invention include:

$(MeO)_3P{=}S$ P-1

$(EtO)_3P{=}S$ P-2

P-3

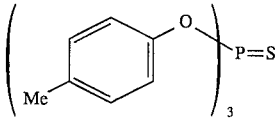

P-4

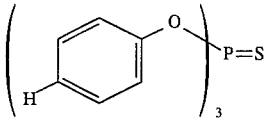

P-5

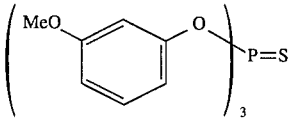

P-6

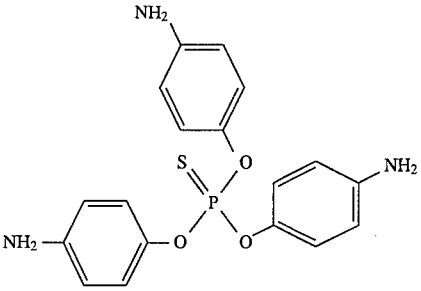

P-10

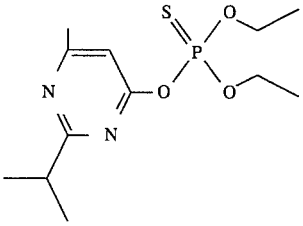

P-11

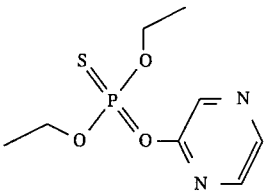

P-12

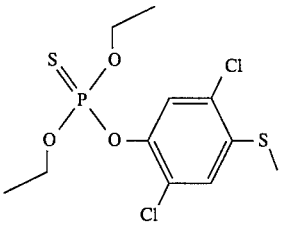

P-13

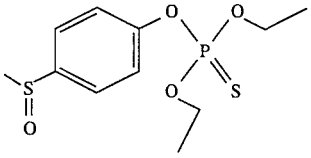

-continued

P-14

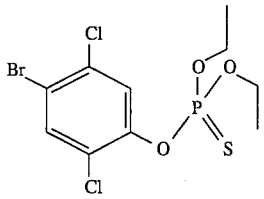

P-15

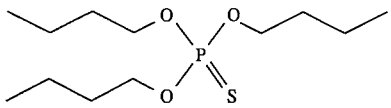

P-16

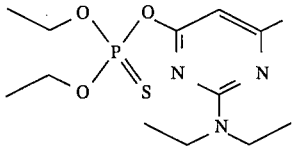

P-17

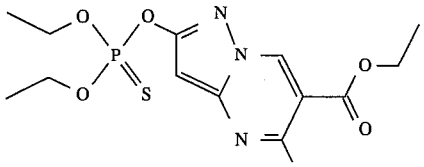

P-18

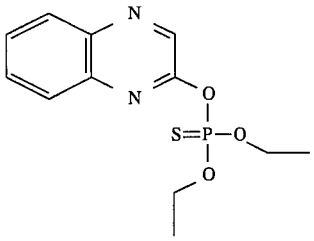

P-19

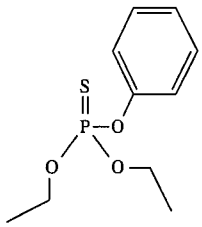

P-20

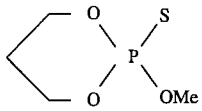

The thiophosphate ester compounds utilized in the invention are incorporated into a silver halide emulsion comprising greater than about 50 mole % silver chloride, and more preferably, greater than 85 mole % silver chloride. Optimally, the emulsion is a silver chloride emulsion substantially free of silver bromide or silver iodide. By substantially free, it is meant that such an emulsion is greater than about 90 and optimally between about 97 and about 99 mole % silver chloride.

The compounds are also preferably utilized in an emulsion that has been digested at a pH of less than 7, and optimally less than 6.5. Also, despite the possibility of incorporating the compounds at any time during the preparation of the emulsion including precipitation, ripening, chemical or spectral sensitization, during the melt or in a coupler dispersion, it is preferred that the compounds be added after chemical sensitization.

The amount of thiophosphate esters that can be incorporated into the silver halide emulsions can be any amount sufficient to achieve the advantages of the invention. Specifically, the thiophosphate esters can be added in an amount between about 0.01 and about 10 mmoles per silver mole, preferably between about 0.1 and about 5 mmoles per silver mole and optimally about 0.2 and 2.5 mmoles per silver mole.

In the preferred practice of the invention, the element's emulsion layer further comprises a sulfinate compound represented by the formula:

$$Z—SO_2M$$

wherein Z is selected from the group consisting of an aliphatic, carbocyclic, or heterocyclic group, and M is a cationic counterion. As with the R substituents described for the thiophosphate ester compound, Z is defined in accordance with generally accepted nomenclature principles and is such as to render the compounds operative to achieve the objects of the invention. Like R, it is capable of being readily determined by one of ordinary skill in the art.

Exemplary aliphatic groups include alkyl, alkene, and alkyne groups, for instance methyl, ethyl, propyl, butyl, pentyl, hexyl, octyl, nonyl, decyl, dodecyl, hexadecyl, octadecyl, isopropyl, t-butyl, butenyl, propynyl, and butynyl.

Exemplary carbocyclic groups are phenyl, tolyl, naphthyl, cyclohexyl, cycloheptatrienyl, cyclooctatrienyl, and cyclononatrienyl.

Exemplary heterocyclic groups are pyrrole, furan, tetrahydrofuran, pyridine, picoline, piperidine, morpholine, pyrrolidine, thiophene, oxazole, thiazole, imidazole, selenazole, tellurazole, triazole, tetrazole, and oxadiazole.

Groups suitable for substitution on Z include alkyl groups (for example, methyl, ethyl, hexyl), fluoroalkyl groups (for example, trifluoromethyl), alkoxy groups (for example, methoxy, ethoxy, octyloxy), aryl groups (for example, phenyl, naphthyl, tolyl), hydroxy groups, halogen groups, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxy groups, cyano groups, sulfo groups, and amino groups.

It is preferred that in the practice of the present invention, Z represents an alkyl group having from 1 to 20 carbon atoms, optionally substituted with a halogen, or an aryl group having from 6 to 20 carbon atoms, which is optionally substituted with a halogen or an alkyl group. More preferred, Z represents an alkyl group having from 1 to 10 carbon atoms, again optionally substituted with a halogen, or an aryl group having 6 to 10 carbon atoms, optionally substituted with a halogen or an alkyl of less than 5 carbon atoms.

Z may further be associated with one or more divalent linking groups and be associated with a thiosulfonate compound; or alternatively, the thiosulfonate compound may be contained in the emulsion independent of the sulfinate compound. Representative thiosulfonate compounds are as described in U.S. Pat. No. 5,001,042, which is incorporated herein by reference.

M is a cationic counterion, preferably a mono-, di-, or tri-valent cation. Thus, it includes metal ions such as sodium ion, potassium ion, calcium ion, and lithium ion. It also includes ammonium and phosphonium ion.

Specific sulfinates suitable for use in the invention are:

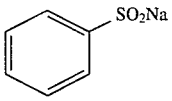

S-1

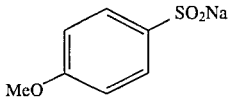

S-2

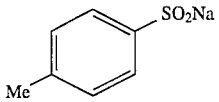

S-3

$EtSO_2Na$ S-4

$NaO_2S-(CH_2)_2-SO_2Na$ S-5

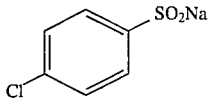

S-6

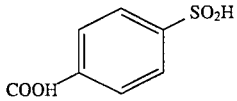

S-7

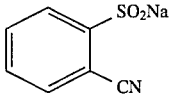

S-8

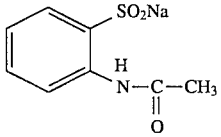

S-9

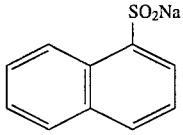

S-10

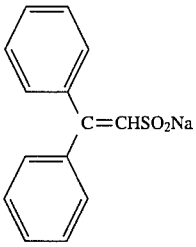

S-11

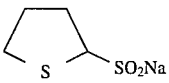

S-12

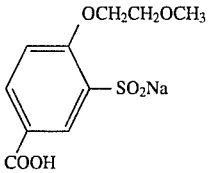

S-13

Many of the sulfinates are commercially available or they may be obtained by reduction of sulfonyl chlorides by methods known to those skilled in the art.

The amount of sulfinates incorporated into the emulsion layer is preferably in the range from about 0.1 to about 100 mmoles per silver mole, more preferably from about 0.1 to about 75 mmoles per silver mole; and optimally from about 0.5 to about 50 mmoles per silver mole. When utilized, it is desired that it be in a ratio to the thiophosphate esters of about 10:1 by weight.

The invention may be practiced with any of the known techniques for emulsion preparation. Such techniques include those which are normally utilized, for instance single jet or double jet precipitation; or they may include forming a silver halide emulsion by the nucleation of silver halide grains in a separate mixer or first container with later growth in a second container. All of these techniques are referenced in the patents discussed in *Research Disclosure,* December 1989, Item 308119, Sections I–IV at pages 993–1000.

After precipitation of the silver halide grains the emulsions are washed to remove excess salt. Both chemical and spectral sensitization may be performed in any conventional manner as disclosed in the above-referenced *Research Disclosure,* Item 308119. The sulfinate compounds, like the thiophosphate ester compounds, may be added at any time during the preparation of the emulsion. It is preferred, however, that they be added to the emulsion just prior to coating.

Dopants and grain surface modifiers may be incorporated into or onto the grains of the emulsions. Incorporated herein by reference are U.S. Pat. Nos. 5,256,530 and 5,252,451 which disclose suitable methods for applying dopants and grain surface modifiers to the emulsions used in the present invention.

As noted, the present invention may be practiced with any silver halide grains having the requisite halide composition. This means that the invention may be practiced with silver halide grains having any form (i.e. cubic, octahedral, dodecahedral, spherical or tabular). When the present invention is practiced with tabular grains, the aspect ratio of such grains may be greater than 2:1, but is preferably at least 5:1, and optimally at least 7:1. Aspect ratio as used herein is understood to mean the ratio of the equivalent circular diameter of a grain to its thickness. The equivalent circular diameter of a grain is the diameter of a circle having an area equal to the projected area of the grain. Examples of high chloride tabular grains are disclosed in U.S. Pat. 5,320,938.

The photographic emulsions may be incorporated into photographic elements as are known in the art. These may include simple single layer elements or multilayer, multicolor elements. Multicolor elements contain dye image-forming units sensitive to each of the three primary regions of the visible light spectrum. Each unit can be comprised of a single emulsion layer or of multiple emulsion layers sensitive to a given region of the spectrum. In addition, each unit's emulsion layer can be comprised of a blend of two or more distinct emulsions having particular characteristics with respect to curve shape. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 microns.

In the following discussion of suitable materials for use with or in the emulsions of this invention, reference will be made to *Research Disclosure,* December 1978, Item 17643, and *Research Disclosure,* December 1989, Item 308119, both published by Kenneth Mason Publications, Ltd., Dudley Annex, 12a North Street, Emsworth, Hampshire PO10 7DQ, ENGLAND, the disclosures of which are incorporated herein by reference. These publications will be identified hereafter by the term "Research Disclosure." A reference to a particular section in "Research Disclosure" corresponds to the appropriate section in each of the above-identified *Research Disclosures.*

The silver halide emulsions can be either monodisperse or polydisperse as precipitated. The grain size distribution of the emulsions can be controlled by silver halide grain-separation techniques or by blending silver halide emulsions of differing grain sizes.

Dopants, as noted, may be added to the grains. Examples of dopants include compounds of copper, thallium, lead, bismuth, cadmium and Group VIII noble metals. The dopants can include transition metal complexes as described in U.S. Pat. Nos. 4,981,781, 4,937,180, and 4,933,272.

The emulsions can be surface-sensitive emulsions, i.e., emulsions that form latent images primarily on the surface of the silver halide grains; or internal latent image-forming emulsions, i.e., emulsions that form latent images predominantly in the interior of the silver halide grains. The emulsions can be negative-working emulsions such as surface-sensitive emulsions or unfogged internal latent image-forming emulsions, but can also be direct-positive emulsions of the unfogged, internal latent image-forming type, which are positive-working when development is conducted with uniform light exposure or in the presence of a nucleating agent.

The silver halide emulsions can further be surface-sensitized, and noble metal (e.g., gold), middle chalcogen (e.g., sulfur, selenium, or tellurium) and reduction sensitizers, employed individually or in combination, are specifically contemplated. Typical chemical sensitizers are listed in *Research Disclosure,* Item 308119, cited above, Section III.

The silver halide emulsions can be spectrally sensitized with dyes from a variety of classes, including the polymethine dye class, which includes the cyanines, merocyanines, complex cyanines and merocyanines (i.e., tri, tetra-, and polynuclear cyanines and merocyanines), oxonols, hemioxonols, stryryls, merostyryls, and streptocyanines. Illustrative spectral sensitizing dyes are disclosed in *Research Disclosure,* Item 308119, cited above, Section IV, and in *Research Disclosure,* 362016, June 1994, page 291.

Suitable vehicles for the emulsion layer and other layers of the photographic elements are described in *Research Disclosure,* Item 308119, Section IX and the publications cited therein.

The elements can include couplers as described in *Research Disclosure,* Section VII, paragraphs D, E, F, and G and the publications cited therein. The couplers can be incorporated as described in *Research Disclosure,* Section VII, paragraph C, and the publications cited therein. Also contemplated are elements which further include image modifying couplers as described in *Research Disclosure,* Item 308119, Section VII, paragraph F.

The photographic elements can contain brighteners (*Research Disclosure,* Section V), antifoggants and stabilizers such as mercaptoazoles (for example, 1-(3-ureidophenyl)-5-mercaptotetrazole), azolium salts (for example, 3-methylbenzothiazolium tetrafluoroborate), thiosulfonate salts (for example, p-toluene thiosulfonate potassium salt), tetraazaindenes (for example, 4-hydroxy-6-methyl-1,3,3a,7-tetraazaindene), and those described in *Research Disclosure,* Section VI, antistain agents and image dye stabilizers (*Research Disclosure,* Section VII, paragraphs I and J), light absorbing and scattering materials (*Research Disclosure,* Section VIII), hardeners (*Research Disclosure,* Section X), polyalkyleneoxide and other surfactants as described in U.S. Pat. No. 5,236,817, coating aids (*Research Disclosure,* Section XI), plasticizers and lubricants (*Research Disclosure,* Section XII), antistatic agents (*Research Disclosure,* Section XIII), matting agents (Research Disclosure, Section XII and XVI) and development modifiers (*Research Disclosure,* Section XXI.

The photographic elements can be coated on a variety of supports as described in *Research Disclosure,* Section XVII and the references described therein.

The photographic elements can be incorporated into exposure structures intended for repeated use or exposure structures intended for limited use, variously referred to as single use cameras, lens with film, or photosensitive material package units. In such units, the photographic elements can be exposed to actinic radiation, typically in the visible region of the spectrum, to form a latent image as described in *Research Disclosure,* Section XVIII, and then processed to form a visible dye image as described in *Research Disclosure,* Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-N,N-diethylaniline hydrochloride, 4-amino-3-methyl-N-ethyl-N-(b-methanesulfonamidoethyl)-aniline sulfate hydrate, 4-amino-3-methyl-N-ethyl-N-(b-hydroxyethyl)-aniline sulfate, 4-amino-3-(b-methanesulfonamidoethyl)-N,N-diethylaniline hydrochloride, and 4-amino-N-ethyl-N-(b-methoxyethyl)-m-toluidine di-p-toluenesulfonic acid.

With negative-working silver halide emulsions, the processing step described above provides a negative image. The described elements can be processed in the known C-41 or RA-4 color processes. To provide a positive (or reversal) image, the color development step can be preceded by development with a non-chromogenic developing agent to develop exposed silver halide, but not form dye, and then uniformly fogging the element to render unexposed silver halide developable. Reversal processing of the element is preferably done in accordance with the known E6 process as described and referenced in *Research Disclosure* paragraph XIX. Alternatively, a direct positive emulsion can be employed to obtain a positive image.

Development is followed by the conventional steps of bleaching, fixing, or bleach-fixing, to remove silver or silver halide, washing, and drying.

The invention can be better appreciated by reference to the following specific examples. They are intended to be illustrative and not exhaustive of the elements of the present invention and their methods of formation.

EXAMPLES

Example 1

An emulsion in accordance with the present invention was made by adding exemplary thiophosphate ester compounds to a chemically and blue spectrally sensitized monodisperse silver chloride negative emulsion having yellow dye-forming coupler alpha-(4-(4-benzyloxy-phenyl-sulfonyl)phenoxy)-alpha(pivaly)-2-chloro-5-(gamma-(2,4-di-5-amylphenoxy)butyramido)acetanilide (1.08 g/m$^2$) in di-n-butylphthalate coupler solvent (0.27 g/m$^2$) and gelatin (1.51 g/m$^2$). In addition, 0.104 g of 1-(3-acetamidophenyl)-5-mercaptotetrazole and 1.033 g of potassium bromide per silver mole were added. The emulsion (0.34 g Ag/m$^2$) was coated on a resin coated paper support and 1.076 g/m$^2$ gel overcoat was applied as a protective layer along with the hardener bis (vinylsulfonyl) methyl ether in an amount of 1.8% of the total gelatin weight.

The coatings were given a 0.1 second exposure, using a 0–3 step tablet (0.15 increments) with a tungsten lamp designed to simulate a color negative print exposure source. This lamp had a color temperature of 3000K, log lux 2.95, and the coatings were exposed through a combination of magenta and yellow filters, a 0.3 ND (Neutral Density), and a UV filter. The processing consisted of a color development (45 sec, 35° C.), bleach-fix (45 sec, 35° C.) and a stabilization or water wash (90 sec, 35° C.) followed by drying (60 sec, 60° C). The chemistry used in the Colenta™ processor consisted of the following solutions:

| | |
|---|---|
| Developer | |
| Lithium salt of sulfonated polystyrene | 0.25 mL |
| Triethanolamine | 11.0 mL |
| N,N-diethylhydroxylamine (85% by wt.) | 6.0 mL |
| Potassium sulfite (45% by wt.) | 0.5 mL |
| Color developing agent (4-(N-ethyl-N-2-methanesulfonyl aminoethyl)-2-methyl-phenylenediaminesesquisulfate monohydrate | 5.0 g |
| Stilbene compound stain reducing agent | 2.3 g |
| Lithium sulfate | 2.7 g |
| Potassium chloride | 2.3 g |
| Potassium bromide | 0.025 g |
| Sequestering agent | 0.8 mL |
| Potassium carbonate | 25.0 g |
| Water to total of 1 liter, pH adjusted to 10.12 | |
| Bleach-fix | |
| Ammonium sulfite | 58 g |
| Sodium thiosulfate | 8.7 g |
| Bhylenediaminetetracetic acid ferric ammonium salt | 40 g |
| Acetic acid | 9.0 mL |
| Water to total 1 liter, pH adjusted to 6.2 | |
| Stabilizer | |
| Sodium citrate | 1 g |

The speed at 1.0 density units was taken as a measure of the sensitivity of the emulsion. Fog was measured at Dmin.

Heat sensitivity data was obtained on a sensitometer which was modified with a water jacket to enable the temperature of the step tablet to be maintained at 22° C. or increased to 40° C. A 0.1 second exposure was made with a 3000K light source and the coatings were processed as above.

Table I demonstrates that the changes in sensitivity ($\Delta Speed_1$), and fog ($\Delta Fog$), of a blue sensitized emulsion containing the invention's thiophosphate ester compounds (samples 2–5) after storage at high temperature and humidity (1 week at 49° C. and 50% RH versus 1 week at −18° C. and 50% RH) are much reduced compared to the samples without the thiophosphate ester compounds. Table I further demonstrates that samples not containing the thiophosphate ester compounds increased in speed ($\Delta Speed_2$) upon exposure to high temperature (40° C. v. 22° C.) during printing, while the coatings containing thiophosphate esters actually decreased in speed.

TABLE I

| $(RPhO)_3P = X$ | | Level (mmole/ | | Stability | | Heat Sensitivity |
|---|---|---|---|---|---|---|
| R | X | Ag mole) | Sample # | $\Delta Speed_1$ | $\Delta Fog$ | $\Delta Speed_2$ |
| Control | | | 1 (control) | 25 | 0.18 | 7 |
| H | S | 0.5 | 2 (P-4) | 12 | 0.06 | −2 |
| H | S | 2.0 | 3 (P-4) | 08 | 0.04 | −10 |
| Me | S | 0.5 | 4 (P-3) | 17 | 0.10 | −0.2 |
| Me | S | 2.0 | 5 (P-3) | 12 | 0.06 | −4 |
| H | — | 2.0 | 6 (comparison) | 40 | 0.23 | 8 |
| H | O | 2.0 | 7 (comparison) | 23 | 0.19 | 6 |
| Me | O | 2.0 | 8 (comparison) | 24 | 0.19 | 6 |

Example 2

In the preferred embodiment of the present invention, the thiophosphate ester compound is added to the emulsion in combination with a sulfinate compound. Tolylthiophosphate (P-3) dissolved in a 50% aqueous methanolic solution was premixed in a ratio of 1:10 by weight with aqueous sodium tolylsulfinate (S-3) and added to a red sensitized emulsion just prior to coating. The emulsion was sensitized as in Example 1 except the emulsion was coated at 0.18 g Ag/m$^2$, and the cyan dye-forming coupler 2-(alpha(2,4-di-tert-amylphenoxy)butyramido)-4,6-dichloro-5-ethyl phenol (0.42 g/m$^2$) in di-n-butyl phthalate coupler solvent (0,429 g/m$^2$) and gelatin (1.08 g/m$^2$) was used. The amount of 1-(3-acetamidophenyl)-5-mercaptotetrazole and potassium bromide was changed to 0.38 and 1.1 g per silver mole, respectively. The coatings were stored at −18° C. and 50% RH and at 49° C. and 50% RH for one week and then exposed and processed as described above. $\Delta Speed_1$, $\Delta Fog$, and $\Delta Speed_2$ are defined as in Table I.

The effects of the combination of thiophosphate esters (P-3) and sulfinates (S-3) are set forth below in Table II.

TABLE II

| P-3 (mg/Ag | S-3 (mg/Ag | | Stability | | Heat Sensitivity |
|---|---|---|---|---|---|
| mole) | mole) | Sample | $\Delta Speed_1$ | $\Delta Fog$ | $\Delta Speed_2$ |
| 0 | 0 | 09 | 03 | 0.10 | 5 |
| 0 | 4800 | 10 | 03 | 0.10 | 5 |
| 162 | 0 | 11 | 05 | 0.07 | −4 |
| 162 | 1620 | 12 | 03 | 0.08 | 3 |
| 342 | 0 | 13 | 06 | 0.07 | −7 |
| 342 | 3420 | 14 | 02 | 0.07 | −1 |
| 649 | 0 | 15 | 06 | 0.08 | −8 |
| 649 | 6490 | 16 | 01 | 0.05 | −1 |

Table II demonstrates that there is no benefit offered by sulfinates (S-3) against either storage changes or temperature increase upon printing (sample 10). It also demonstrates that the use of a thiophosphate ester (P-3) by itself reduces the fog increase after storage, and provides substantial resistance to speed increase when the emulsion is subjected to high printing temperatures. However, there is also a significant gain in sensitivity due to incubation when the thiophosphate ester (P-3) is used alone (samples 11, 13, and 15). The advantages of the invention's preferred embodiment, i.e., the combination of a thiophosphate ester and a sulfinate (samples 12, 14, and 16), reside in the ability to obtain a high resistance to temperature induced sensitivity changes ($\Delta Speed_2$), in combination with both fog ($\Delta Fog$) and speed ($\Delta Speed_1$) storage stability.

The invention has been described in detail with particular reference to preferred embodiments thereof but it will be understood that variations and modifications can be effected within the spirit and scope of the invention.

What is claimed is:

1. A photographic element comprising a support having thereon a silver halide emulsion layer which is greater than about 50 mole % silver chloride, wherein the emulsion layer contains a thiophosphate ester of the structure:

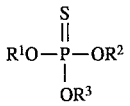

wherein $R^1$, $R^2$ and $R^3$ are independently selected from the group consisting of an aliphatic, carbocyclic or heterocyclic group, and wherein any two of $R^1$, $R^2$ and $R^3$ may be bonded together to form a 5 or 6-membered ring.

2. A photographic element according to claim 1 wherein the silver halide emulsion layer is greater than about 85 mole % silver chloride.

3. A photographic element according to claim 2 wherein $R^1$, $R^2$ and $R^3$ independently represent an alkyl group having from 1 to 20 carbon atoms, optionally substituted with a halogen, or an aryl group having from 6 to 20 carbon atoms, which is optionally substituted with a halogen or an alkyl group.

4. A photographic element according to claim 3 wherein $R^1$, $R^2$ and $R^3$ independently represents an alkyl group having from 1 to 10 carbon atoms, optionally substituted with a halogen, or an aryl group having 6 to 10 carbon atoms, optionally substituted with a halogen or an alkyl of less than 5 carbon atoms.

5. A photographic element according to claim 2 wherein the thiophosphate compound is selected from the group consisting of:

$(MeO)_3P{=}S$ P-1

$(EtO)_3P{=}S$ P-2

P-3

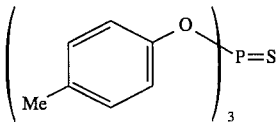

P-4

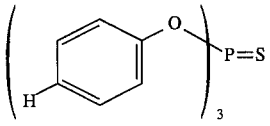

P-5

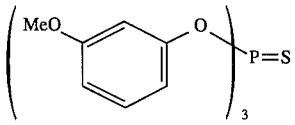

-continued

P-6

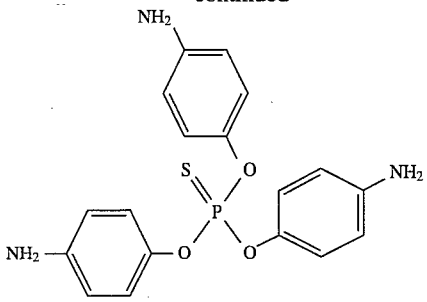

P-7

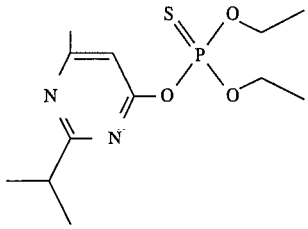

P-8

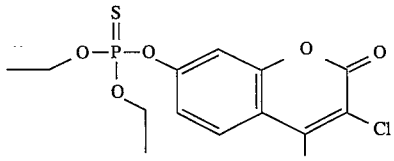

P-9

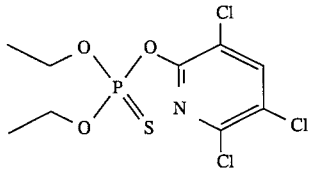

P-10

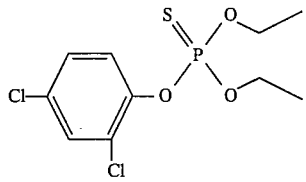

P-11

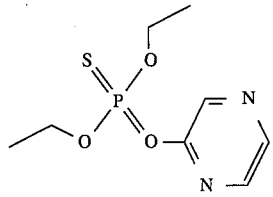

P-12

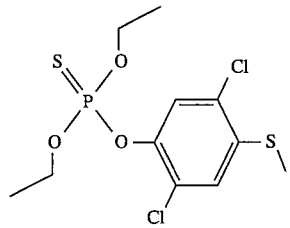

-continued

P-13

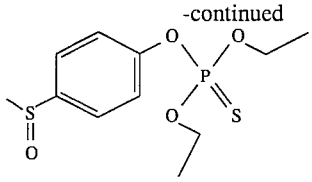

P-14

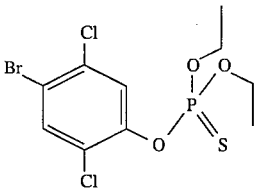

P-15

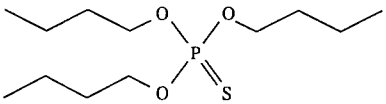

P-16

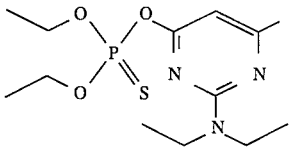

P-17

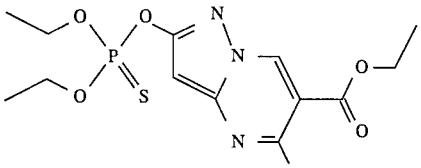

P-18

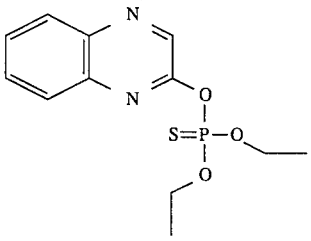

P-19

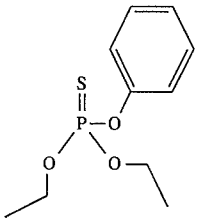

P-20

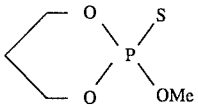

6. A photographic element according to claim 1 further comprising a sulfinate compound of the structure:

$$Z—SO_2M$$

wherein Z is selected from the group consisting of an aliphatic, carbocyclic, or heterocyclic group, and M is a cationic counterion.

7. A photographic element according to claim 6 wherein the silver halide emulsion layer is greater than about 85 mole % silver chloride.

8. A photographic element according to claim 7 wherein Z represents an alkyl group having from 1 to 20 carbon atoms, optionally substituted with a halogen, or an aryl group having from 6 to 20 carbon atoms, which is optionally substituted with a halogen or an alkyl group.

9. A photographic element according to claim 8 wherein Z represents an alkyl group having from 1 to 10 carbon atoms, optionally substituted with a halogen, or an aryl group having 6 to 10 carbon atoms, optionally substituted with a halogen or an alkyl of less than 5 carbon atoms.

10. A photographic element according to claim 7 wherein the sulfinate compound is selected from the group consisting of:

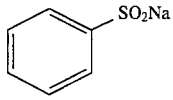

S-1

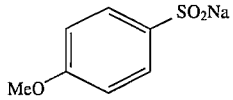

S-2

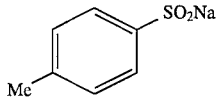

S-3

$EtSO_2Na$ S-4

$NaO_2S-(CH_2)_2-SO_2Na$ S-5

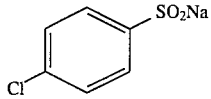

S-6

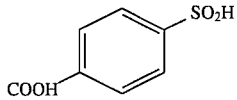

S-7

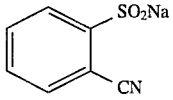

S-8

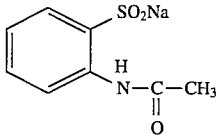

S-9

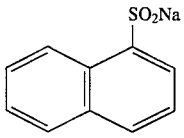

S-10

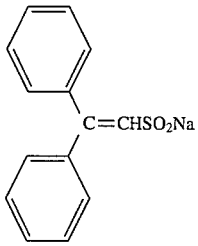

S-11

-continued

S-12

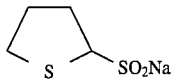

S-13

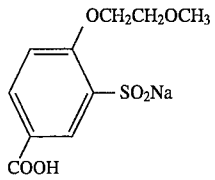

11. A photographic element comprising a silver halide emulsion having a silver chloride content greater than about 50 mole %, wherein the emulsion is prepared by precipitation, chemical and spectral sensitization, and wherein after such steps, a thiophosphate compound having the structure:

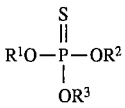

wherein $R^1$, $R^2$ and $R^3$ are independently selected from the group consisting of an aliphatic, carbocyclic or heterocyclic group, is added to emulsion.

12. A photographic element according to claim 11 further comprising a sulfinate compound of the structure:

$$Z—SO_2M$$

wherein Z is selected from the group consisting of an aliphatic, carbocyclic, or heterocyclic group, and M is a cationic counterion.

* * * * *